US011453521B2

(12) United States Patent
Sia et al.

(10) Patent No.: US 11,453,521 B2
(45) Date of Patent: Sep. 27, 2022

(54) AUTOMATIC DUNNAGE CONFORMING APPARATUS AND METHOD

(71) Applicant: Ranpak Corp., Concord Township, OH (US)

(72) Inventors: Jean-Yves Sia, Dijon (FR); Uwe Klärner, Dijon (FR); Rémi Parisse, Dijon (FR)

(73) Assignee: Ranpak Corp., Concord Township, OH (US)

( * ) Notice: Subject to any disclaimer, the term of this patent is extended or adjusted under 35 U.S.C. 154(b) by 284 days.

(21) Appl. No.: 16/963,854

(22) PCT Filed: Feb. 6, 2019

(86) PCT No.: PCT/US2019/016738
§ 371 (c)(1),
(2) Date: Jul. 22, 2020

(87) PCT Pub. No.: WO2019/156994
PCT Pub. Date: Aug. 15, 2019

(65) Prior Publication Data

US 2021/0039819 A1 Feb. 11, 2021

Related U.S. Application Data

(60) Provisional application No. 62/627,584, filed on Feb. 7, 2018.

(51) Int. Cl.
*B65B 55/20* (2006.01)
*B65B 61/22* (2006.01)
*B65B 63/02* (2006.01)

(52) U.S. Cl.
CPC ..... *B65B 55/20* (2013.01); *B65B 61/22* (2013.01); *B65B 63/02* (2013.01)

(58) Field of Classification Search
CPC ..... B65B 63/02; B65B 61/22; B65B 55/20
See application file for complete search history.

(56) References Cited

U.S. PATENT DOCUMENTS 7,788,884 B2 * 9/2010 Cheich ..... B31D 5/0047 53/238
7,866,125 B2 1/2011 Simmons, Jr.
(Continued)

FOREIGN PATENT DOCUMENTS

GB 983885 A 2/1965
WO 99/14033 A2 3/1999

OTHER PUBLICATIONS

International Preliminary Report on Patentability dated Aug. 11, 2020, for International Patent Application No. PCT/US2019/016738.

(Continued)

*Primary Examiner* — Joshua G Kotis
*Assistant Examiner* — Scott A Howell
(74) *Attorney, Agent, or Firm* — Renner, Otto, Boisselle & Sklar, LLP

(57) ABSTRACT

An apparatus for conforming a dunnage element about contents in a container includes an array of pushers having biased end portions that are movable relative to one another and having end faces for engaging the dunnage element. The end faces of the pushers are biased to an extended state and are movable against the bias in response to engagement of the end faces with the contents and with the dunnage element between the end faces and the contents. At least one of the pushers is movable against the bias separately from a remainder of the pushers to enable conformance of the array to the shape of the contents. The pushers are mounted to a (Continued)

carrier at respective mounts. A motive device is coupled to the carrier and is configured to collectively move the mounts vertically.

16 Claims, 1 Drawing Sheet

(56) References Cited

U.S. PATENT DOCUMENTS

| | | | | |
|---|---|---|---|---|
| 9,321,234 | B2 | 4/2016 | Cheich | |
| 9,636,274 | B2 * | 5/2017 | Monti | B65B 39/145 |
| 10,926,506 | B2 * | 2/2021 | Wetsch | B31D 5/0039 |
| 2002/0129583 | A1 * | 9/2002 | Simmons, Jr. | B31D 5/0047 53/238 |
| 2021/0039819 | A1 * | 2/2021 | Sia | B65B 63/02 |

OTHER PUBLICATIONS

International Search Report and Written Opinion dated Jun. 3, 2019 for International Patent Application No. PCT/US2019/016738.

* cited by examiner

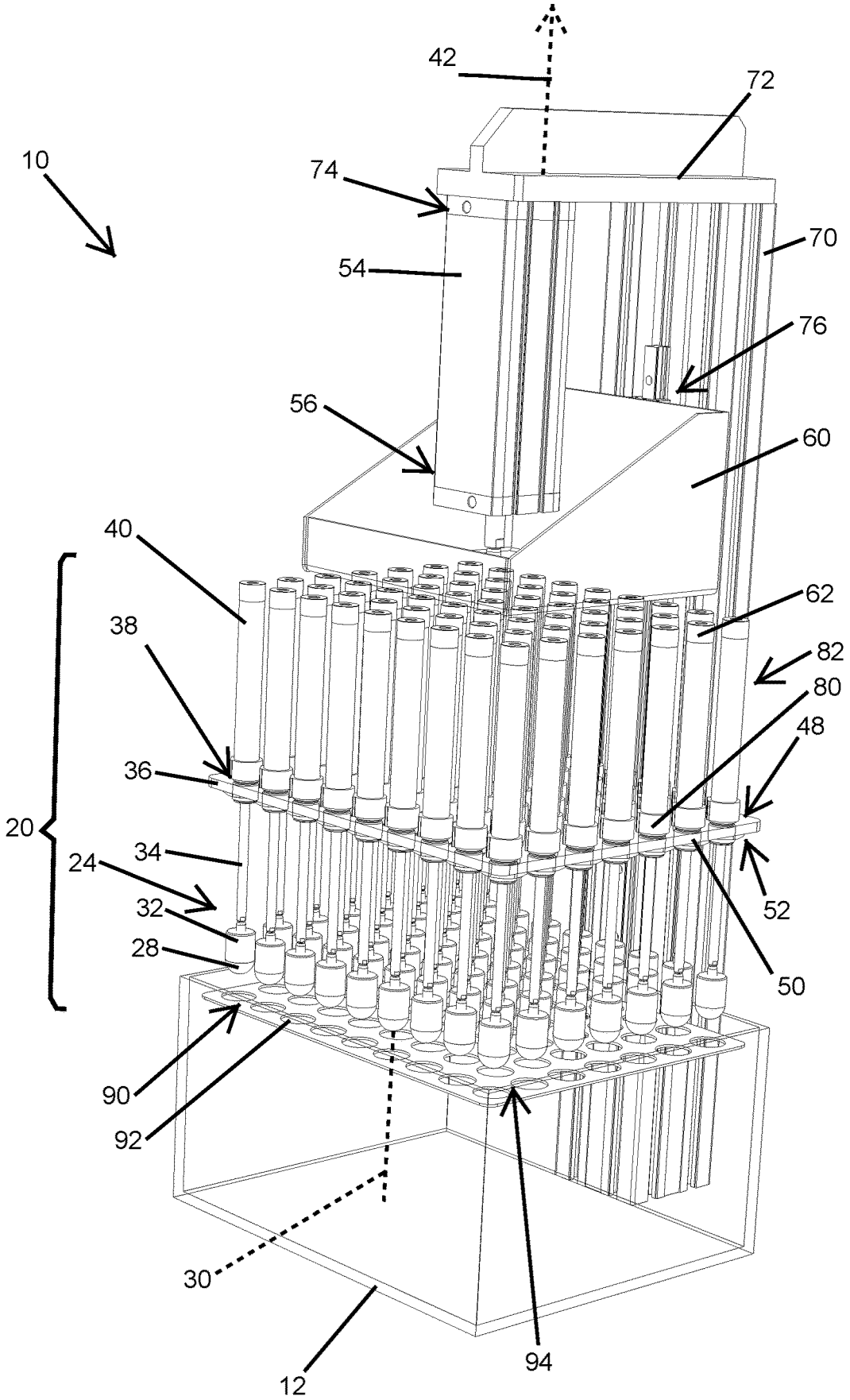
42
72
10
74
70
54
76
56
60
40
62
38
82
80
48
36
20
34
24
52
32
28
50
90
92
30
94
12

AUTOMATIC DUNNAGE CONFORMING APPARATUS AND METHOD

RELATED APPLICATIONS

This application is a national phase of International Application No. PCT/US2019/016738, filed Feb. 6, 2019, and published in the English language, and which claims priority to U.S. Application No. 62/627,584, filed Feb. 7, 2018, both of which are hereby incorporated herein by reference in their entireties.

FIELD OF THE INVENTION

The present invention relates generally to an apparatus for inserting dunnage into a shipping container having contents to be packaged therein, and more particularly to an apparatus for conforming dunnage about the shape of contents in a container to limit shifting of the contents relative to the container during shipment.

BACKGROUND

In the process of shipping one or more articles from one location to another, a packer typically places some type of dunnage element in a shipping container, such as a cardboard box, along with the article or articles to be shipped. The dunnage element typically is used to wrap the articles or to partially or completely fill the empty space or void volume around the articles in the shipping container. By filling the void volume, the dunnage prevents or minimizes movement of the articles that might lead to damage during the shipment process. The dunnage element also can perform blocking, bracing, or cushioning functions. Some commonly used dunnage elements are plastic foam peanuts, plastic bubble pack, air bags, and converted paper dunnage material.

A dunnage element typically is placed into the shipping container by hand or by dropping the dunnage element into the opening of the container, such as from an elevated position or by sliding the dunnage element into the container. Cushioning about the contour of the contents with a dunnage element other than peanuts typically requires manual application of the dunnage element, which may result in any one or more of the following: over-compression of the dunnage element such that the dunnage element loses cushioning properties, failure to result in conformance of the dunnage element to the contour, or only partial conformance of the dunnage element to the contour.

SUMMARY

The present invention provides an apparatus for application of a dunnage element into conformance with a contour of contents such as contents disposed in a shipping container. The apparatus provides for engagement with varying dimensions of the contents to enable the dunnage element to be conformed to the varying dimensions, while also preferably allowing for tucking of the dunnage element between an outer periphery of the contents and an inner periphery of the container. The conformance of the dunnage element to the contour or shape of the contents limits the shifting of the contents relative to the container. The application of the dunnage element is automated by the apparatus for quick and efficient placement of the dunnage element about the contents in the container.

The apparatus reduces or eliminates one or more deficiencies of conventional apparatuses using an array of pushers wherein at least some of the pushers are separately biased from other of the pushers, enabling the array to conform to the contour of the contents when brought into engagement therewith. The pushers are commonly mounted to a carrier at pusher mounts, and the carrier is movable to collectively move the pusher mounts toward the contents. The pushers are biased in extended positions able to be brought into engagement with the dunnage element being applied to the contents. The pushers are configured to move against the bias in response to engagement with the contents to apply the dunnage element thereabout.

Conformance of dunnage element with a contour of the contents is automatic, and the apparatus provides for quick and efficient cushioning of the contents in the container. The biasing of the pushers enables the array to conform the dunnage element to the contents without damaging the contents or unduly compressing the dunnage element, to thereby adequately cushion the contents relative to the container.

According to one aspect of the invention, an apparatus for conforming a dunnage element about the shape of contents of a container includes an array of pushers movable relative to one another and having end faces for engaging the dunnage element to cause the dunnage element to conform to the shape of the contents in the container, wherein the pushers are biased to an extended state and are movable against the bias in response to engagement of the end faces by the contents, and wherein at least one of the pushers of the array is movable against the bias separately from a remainder of the pushers to enable conformance to the shape of the contents.

The dunnage conforming apparatus may include a motive device to which the array is coupled for moving the end faces into the engagement with the contents.

The pushers of the array may be collectively mounted to a common carrier.

The pushers of the array may be aligned for movement relative to one another along parallel vertically-disposed axes.

At least one pusher may include a piston and a tip coupled to the piston, wherein the tip is resiliently movable relative to the piston.

The apparatus may be configured to maintain the end faces relatively planar to one another with the pushers in their respective extended states.

The dunnage conforming apparatus may include a carrier to which each of the pushers of the array is mounted at a respective mount in their respective extended states.

Each of the pushers of the array may be individually biased.

The bias applied to the pushers may be adjustable for at least one of the pushers.

The bias applied to the pushers may be varied such that at least one of the pushers is acted on by a different biasing force than the at least one other pusher of the array of pushers.

At least one pusher disposed at a periphery of the array may be biased to the extended state by a greater biasing force than at least one pusher disposed inwardly of the periphery of the array.

The dunnage conforming apparatus may include at least one biasing element to apply the bias, (i) wherein the biasing element is a spring, or (ii) wherein the biasing element is configured to regulate a gas flow applying a biasing force against one or more of the pushers.

The dunnage conforming apparatus may include an apertured plate coupled relative to the array, the apertured plate having apertures aligned relative to the pushers to allow the pushers to be moved through the apertured plate, and the apertured plate having an application state disposed vertically below the extended state of the pushers for being moved to apply the dunnage element to a position of an uppermost elevation of the contents relative to a bottom section of the container.

The apertured plate may be movable relative to the array.

According to another aspect of the invention, a dunnage conforming apparatus for applying a dunnage element about contents in a container includes an array of interconnected vertically-biased sections configured to push dunnage element into the container and to be brought into engagement with the contents, wherein the array is configured to vertically conform to varying dimensions of the contents upon the engagement of the sections with the contents to conform the dunnage element to the varying dimensions of the contents.

According to yet another aspect of the invention, a dunnage conforming apparatus for applying a dunnage element about contents in a container includes an array of pushers that are separately vertically-biased relative to one another, a carrier to which each of the pushers is mounted at a respective mount in an extended and biased state, and a motive device coupled to the carrier and configured to collectively move the mounts vertically. The pushers are configured to be separately vertically movable against the bias in response to engagement with varying dimensions of the contents to conform the dunnage element about the shape of the contents.

Vertical axes along which the pushers are movable may be aligned parallel to one another.

The bias applied to at least one of the pushers may be adjustable.

The bias applied to the pushers may be varied such that at least one of the pushers is acted on by a different biasing force than the remainder of the pushers.

According to still another aspect of the invention, a method of limiting shifting of contents of a container relative to the container includes the steps of (a) placing a dunnage element onto the contents, (b) engaging the dunnage element with a plurality of end faces of pushers disposed in an array, (c) engaging varying dimensions of the contents with differing pushers of the array, wherein the pushers are vertically biased to extended positions prior to the engagement with the contents, and wherein the engagement of the pushers with the contents includes collective movement of the pushers in their extended positions into the engagement of the pushers with the varying dimensions of the contents, and (d) conforming the dunnage element to the varying dimensions of the contents via movement of the pushers against the bias in response to the engagement of the pushers with the varying dimensions.

According to another aspect of the invention, a dunnage-insertion apparatus for automatically conforming a dunnage element about contents in a shipping container includes an array of pushers collectively movable in an insertion direction, each pusher having an end portion configured to engage a dunnage element, each end portion being biased in the insertion direction to engage a dunnage element, and the array of pushers cooperating to conform the dunnage element to the shape of the contents in the container.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

BRIEF DESCRIPTION OF THE DRAWINGS

FIG. 1 is a perspective view of an exemplary dunnage conforming apparatus provided in accordance with the present invention.

DETAILED DESCRIPTION

The present invention provides an apparatus for application of a dunnage element into conformance with a contour of contents such as contents disposed in a shipping container. The apparatus provides for engagement with varying dimensions of the contents to enable the dunnage element to be conformed to the varying dimensions, while also preferably allowing for tucking of the dunnage element between an outer periphery of the contents and an inner periphery of the container. The conformance of the dunnage element to the contour or shape of the contents limits the shifting of the contents relative to the container. The application of the dunnage element is automated by the apparatus for quick and efficient placement of the dunnage element about the contents in the container.

Referring now to FIG. 1, the present invention provides an apparatus 10 for automatically conforming a dunnage element to a contour of contents of a container 12. In the illustrated exemplary embodiment, the apparatus 10 includes an array 20 of pushers 24 aligned along parallel axes in the array 20. The pushers 24 generally are arranged to have vertical axes and sections vertically-biased along the axes, which are configured to push dunnage into the container 12. Biasing of the sections enables the sections to be separately movable relative to one another in response to engagement of respective sections with varying dimensions of the contents, which may include varying heights. This construction in turn allows for the array 20, and the dunnage element being pushed by the array 20, to conform to the contour of the contents, providing for automated and conforming cushioning of the contents in the container 20.

More specifically, the apparatus 10 includes an array 20 of pushers 24, preferably formed by a plurality of parallel plungers biased in a common direction. The pushers 24 are movable relative to one another and each has an end face 28 for engaging the dunnage element to cause the dunnage element to conform to the shape of the contents in the container 12. The pushers 24 are biasable from a shortened state to an extended state and are movable against the bias in response to the engagement of the end faces 28 with the contents. At least one of the pushers 24 is movable against the bias separately from a remainder of the pushers 24 to enable conformance of the array 20 to the shape of the contents.

In a preferred embodiment, the pushers 24 are each separately and individually movable relative to one another, and also are each individually biased. As illustrated in FIG. 1, the pushers 24 are separately vertically biased, and are arranged along parallel vertical axes relative to one another within the array 20. The pushers are parallelly aligned for vertical movement collectively towards the container 12 and also for movement in an opposite vertical direction against the applied bias along separate parallel vertically disposed axes 30.

The pushers 24 include tips 32 coupled to pistons 34 that are mounted to a common carrier 36 at mounts 38. The tips 32 each include an end face 28 of the pushers 24, and are positioned to engage the dunnage and the contents of the container 12 via the dunnage element. In some embodiments, one or more of the tips 32 may be resiliently movable relative to the respective pistons 34. The collective mounting of the pushers 24 to the common carrier 36 allows for collective movement of the pushers 24 towards and away from the container 12, such as along a central vertical axis 42 of the array 20.

The illustrated mounts 38 each include a cylinder 40 in which the respective pistons 34 are received and movable. The cylinders 40 are coupled to the common carrier 36, such as by one or more suitable fasteners. In other embodiments, the mounts 38 may be integral with the common carrier 36, such as the common carrier defining cylindrical chambers for receipt of the pistons 34.

The common carrier 36 is depicted as a carrier plate 36 to which each of the pushers 24 is mounted via the cylinders 40. The cylinders 40 each are mounted at an upper side 48 of the carrier plate 36 at an aperture 50 of the carrier plate 36. The apertures 50 allow the pistons 34 to extend through the carrier plate 36 to an opposite under side 52 of the carrier plate 36. In some embodiments, the cylinders 40 instead may be mounted to the under side 52 of the carrier plate 36.

A motive device 54 is coupled to the array 20, and more particularly to the carrier plate 36, for moving the end faces 28 along the vertical axis 42 in an insertion direction into engagement with the contents of the container 12 and with the dunnage element disposed thereon. Activation of the motive device 54 collectively moves the mounts 38 along the vertical axis 42 of the array 20 as a result of the coupling of the motive device 54 to the carrier plate 36. The illustrated motive device 54 is a linear actuator, such as a piston-cylinder assembly, although other different motive devices may be suitable in other embodiments.

A proximal end 56 of the motive device 54 is coupled to a support member 60 from which one or more vertical elements, such as the illustrated support rods 62, extend for coupling of the carrier plate 36 to the motive device 54.

The apparatus 10 is illustrated as including a vertical support 70 having a lateral section 72 to which a distal end 74 of the motive device 54 is coupled. Each of the support member 60 and the carrier plate 36 may have a respective alignment section 76 slidably coupled to the vertical support 70 for guiding vertical movement of the support member 60 and of the carrier plate 36 in response to activation of the motive device 54. A depicted alignment section 76 of the support member 60 is configured as a key received into a slot of the vertical support 70, although other constructions may be suitable.

In use, each of the pushers 24 is biased to a default extended position by a biasing force applied by a biasing element. As illustrated, each of the pushers 24 is biased by a compressed gas supply biasing element (not shown) coupled to gas connections 80 that are coupled to the carrier plate 36. The gas connections 80 in turn are fluidly coupled to the cylinders 40, such as by suitable gas connectors, e.g., tubing. A greater number of pushers 24 than gas connections 80 may be provided, such that the pushers 24 may not be each biased by a separate biasing element.

A biasing force of the gas applied to the pistons 34 of the pushers 24 may be adjustably controlled, such as via use of one or more regulators (not shown). For example, the bias applied to the pushers 24 may be varied such that at least one of the pushers 24 is acted on by a different biasing force than the remainder of the pushers, such as via control of the gas using a regulator. In one embodiment, one or more of pushers 24 disposed at a periphery of the array 20 may be biased to the extended state by a greater biasing force than pushers 24 disposed inwardly of the periphery.

In some embodiments, the biasing force applied to each pusher 24 may be separately adjustable.

In some embodiments, the apparatus 10 may be configured, such as via use of one or more biasing elements, to maintain the end faces 28 relatively planar to one another with the pushers 24 in their respective extended states.

In some embodiments, any number of pistons 34 of the pushers 24 may be fixed for common movement and/or may be commonly biased by a common biasing element.

In some embodiments, the biasing force may be alternatively or additionally provided via a resilient biasing element, such as a spring. In such case, a compressing member may be adjustable relative to the spring to provide for adjustment of the biasing force of the spring.

The apparatus 10 shown in FIG. 1 also includes a distal apertured plate 90. The apertured plate 90 is coupled relative to the array 20 and has apertures 92 extending therethrough. The apertures 92 are aligned relative to the end faces 28 of the pushers 24 to allow the end faces 28 to be moved through the apertured plate 90. The apertured plate 90 has an application state disposed vertically below the extended state of the pushers 24 for being moved to apply the dunnage to a position of an uppermost elevation of the contents in the container 12 relative to a bottom section of the container 12 (spaced farthest from the bottom of the container 12).

In some embodiments, the apertured plate 90 may be moved relative to the array 20 from the application state of the apertured plate 90 to a raised state vertically above the application state. In some embodiments such movement may be via a motive device and/or via a biasing element, which may be coupled relative to the array. In other embodiments, the apertured plate 90 may be omitted.

A suitable dunnage for conforming against the contents may be a dunnage pad or other cushioning dunnage element including two or more sheets of sheet material coupled to one another at one or more spaced-apart locations and having vertically lofted sections adjacent the compressed spaced-apart locations to provide cushioning properties.

In some embodiments, an oversized dunnage element may be used, such as an oversized dunnage pad or other cushioning dunnage element. The oversized dunnage element may have at least one of a length dimension or a width dimension that is larger than a respective length dimension or a respective width dimension of an opening 94 of the container 12. This oversized dimension may provide for adequate dunnage to enable tucking of one or more portions of the dunnage element between an outer periphery of the contents and an inner periphery of the container 12.

An exemplary sheet material which may form the basis of the dunnage element is paper, such as kraft paper, and more particularly is a single-ply kraft paper. Suitable kraft paper may have various basis weights, such as twenty-pound or forty-pound, for example. In some embodiments, the sheet material may be laminated or may include any other suitable material such as another paper, plastic sheet, metal foil, or any combination thereof. Paper is an environmentally-responsible stock material that is recyclable, biodegradable, and composed of a renewable resource.

In use, a first dunnage element may be applied to a bottom of the container 12 via vertical translation of the array 20, the apertured plate 90, or a combination thereof. Once contents to be packaged are placed on top of the first dunnage element, a second dunnage element may be automatically applied via use of the array 20 or via a combination of the array 20 and the apertured plate 90, moved in an insertion direction toward the contents.

In summary, the present invention provides an apparatus 10 for conforming a dunnage element about contents in a container 12. The apparatus 10 includes an array 20 of pushers 24 having biased end portions that are movable relative to one another and having end faces 28 for engaging the dunnage element. The end faces 28 of the pushers 24 are biased to an extended state and are movable against the bias in response to engagement of the end faces 28 with the contents and with the dunnage element between the end faces 28 and the contents. At least one of the pushers 24 is movable against the bias separately from a remainder of the pushers 24 to enable conformance of the array 20 to the shape of the contents. The pushers 24 are mounted to a carrier 36 at respective mounts 38. A motive device 54 is coupled to the carrier 36 and is configured to collectively move the mounts 38 vertically.

The present invention also includes a method of limiting shifting of contents of the container 12 relative to the container 12. The method includes the steps of (a) placing a dunnage element onto the contents, (b) engaging the dunnage element with a plurality of end faces 28 of pushers 24 disposed in an array 20, (c) engaging varying dimensions of the contents with differing pushers 24 of the array 20, wherein the pushers 24 are vertically biased to extended positions prior to the engagement with the contents, and wherein the engagement of the pushers 24 with the contents includes collective movement of the pushers 24 in their extended positions into the engagement with the varying dimensions of the contents, and (d) conforming the dunnage element to the varying dimensions of the contents via movement of the pushers 24 against the bias in response to the engagement of the pushers 24 with the varying dimensions.

Although the invention has been shown and described with respect to a certain illustrated embodiment or embodiments, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiment or embodiments of the invention. The term "coupling" may refer to direct coupling of one integer to another or to indirect coupling of integers, such as with one or more integers therebetween. The term "and/or," such as used in "a and/or b" is defined as including either or both of (i) a and b and (ii) a or b.

The invention claimed is:

1. A system comprising a supply of containers, a supply of dunnage elements, and a dunnage conforming apparatus for applying a dunnage element from the supply of dunnage elements about contents in a container from the supply of containers, wherein the dunnage conforming apparatus includes an array of pushers movable relative to one another and having end faces for engaging the dunnage element to cause the dunnage element to conform to the shape of the contents in the container, wherein the pushers are defaultly biased to an extended state and are movable against the bias in response to engagement of the end faces by the contents, and wherein at least one of the pushers is movable against the bias separately from a remainder of the pushers to enable conformance to the shape of the contents.

2. The system of claim 1, further including a motive device to which the array is coupled for moving the end faces into the engagement with the contents.

3. The system of claim 1, wherein the pushers of the array are collectively mounted to a common carrier.

4. The system of claim 1, wherein the pushers of the array are aligned for movement relative to one another along parallel vertically-disposed axes.

5. The system of claim 1, wherein at least one the pushers includes a piston and a tip coupled to the piston, wherein the tip is resiliently movable relative to the piston.

6. The system of claim 1, wherein the apparatus is configured to maintain the end faces relatively planar to one another with the pushers in their respective extended states.

7. The system of claim 1, further including a carrier to which each of the pushers of the array is mounted at a respective mount in their respective extended states.

8. The system of claim 1, wherein each of the pushers of the array is individually biased.

9. The system of claim 1, wherein the bias applied to the pushers is adjustable for at least one of the pushers.

10. The system of claim 1, wherein the bias applied to the pushers is varied such that at least one of the pushers is acted on by a different biasing force than the remainder of the pushers.

11. The system of claim 10, wherein at least one pusher disposed at a periphery of the array is biased to the extended state by a greater biasing force than at least one pusher disposed inwardly of the periphery of the array.

12. The system of claim 1, further including at least one biasing element to apply the bias, and wherein the biasing element is a spring.

13. The system of claim 1, further including at least one biasing element to apply the bias, and wherein the biasing element is configured to regulate a gas flow applying a biasing force against one or more of the pushers.

14. The system of claim 1, further including an apertured plate coupled relative to the array, the apertured plate having apertures aligned relative to the pushers to allow the pushers to be moved through the apertured plate, and the apertured plate having an application state disposed vertically below the extended state of the pushers for being moved to apply the dunnage element to a position of an uppermost elevation of the contents relative to a bottom section of the container.

15. The system of claim 14, wherein the apertured plate is movable relative to the array.

16. A method of limiting shifting of contents of a container relative to the container includes the steps of:

providing a supply of containers with contents for shipment;

providing a supply of dunnage elements;

placing a dunnage element from the supply of dunnage elements onto the contents in a container from the supply of containers;

engaging the dunnage element with a plurality of end faces of pushers disposed in an array;

engaging varying dimensions of the contents with differing pushers of the array, wherein the pushers are vertically biased to extended positions prior to the engagement with the contents, and wherein the engagement of the pushers with the contents includes collective movement of the pushers in their extended positions into the engagement with the varying dimensions of the contents; and conforming the dunnage element to the varying dimensions of the contents via movement of the pushers against the bias in response to the engagement of the pushers with the varying dimensions.

* * * * *